United States Patent [19]

Harlan

[11] Patent Number: 4,949,960

[45] Date of Patent: Aug. 21, 1990

[54] BUTTERFLY CHAIR STRETCHING APPARATUS

[75] Inventor: Sven Harlan, Norwalk, Conn.

[73] Assignee: Ballet Design, Inc., Norwalk, Conn.

[21] Appl. No.: 338,186

[22] Filed: Apr. 14, 1989

[51] Int. Cl.[5] ..... A63B 103/00

[52] U.S. Cl. ..... 272/138; 272/134; 272/143; 272/144; 272/903

[58] Field of Search ..... 272/903, 144, 134, 135, 272/142, 136, 138, 72

[56] References Cited

U.S. PATENT DOCUMENTS

| | | | |
|---|---|---|---|
| 3,109,646 | 11/1963 | Klein | 272/903 X |
| 4,277,062 | 7/1981 | Lawrence | 272/903 X |
| 4,750,741 | 6/1988 | Smolanovich | 272/144 |
| 4,795,150 | 1/1989 | Harlan | 272/903 X |
| 4,815,732 | 3/1989 | Mahvi | 272/903 X |
| 4,818,018 | 4/1989 | Yamasaki | 272/144 X |

FOREIGN PATENT DOCUMENTS

| | | | |
|---|---|---|---|
| 3343634 | 6/1985 | Fed. Rep. of Germany | 272/143 |

*Primary Examiner*—Richard J. Apley
*Assistant Examiner*—D. F. Crosby
*Attorney, Agent, or Firm*—Norman B. Rainer

[57] ABSTRACT

A stretching apparatus for stretching leg and hip muscles and increasing rotation of the leg in the hip joint of a human user. Flexible straps attach two body support platforms to a frame. Movement of one of the body support platforms to a reclining position against the force of the straps forces the knees of a user outward, thus stretching the leg and hip muscles and causing the legs to rotate in the hip joints, increasing flexibility in the joints.

4 Claims, 2 Drawing Sheets

BUTTERFLY CHAIR STRETCHING APPARATUS

BACKGROUND OF THE INVENTION

The present invention relates to an apparatus and method for stretching human muscles to facilitate rotation of the legs in the hip joint.

Flexibility of muscles and increased rotation of the leg in the hip joint are desirous for several reasons. Increased flexibility and rotation enables increased performance in sports involving kicking, such as the martial arts and soccer, and in activities requiring fluid and graceful body movement, such as dance, running and gymnastics. A flexible hip joint enables a classical dancer to turn his or her feet and legs out from the hip joints to a 90 degree position from center, giving the dancer freedom of movement in every direction. Stretched muscles and flexible joints also are less likely to become pulled, torn or otherwise injured during exercise.

Devices and methods designed to increase flexibility of the hip joint and rotation of the leg are known. One simple method consists of nailing ballet shoes to the floor with the heels together and toes 180 degrees apart. A dancer stands in the shoes for an amount of time sufficient to increase rotation in the hip joint. However, this method strains the knee joint and causes it to rotate unnaturally. This method is also cumbersome and sometimes causes the user to fall forward or backward with the risk of serious injury.

Other devices designed to stretch muscles and increase flexibility in the hip joint include a device comprising two metal tubes joined end-to-end by a perpendicular shorter tube. An individual sits on the floor, straps the longer tubes to the legs, one on each ankle, and uses the shorter tube to pull the device toward the body, thus increasing the angle between the longer tubes and forcing the legs apart, causing the leg muscles to stretch. These devices tend to stretch groin muscles instead of hip and leg muscles, creating little or no increased flexibility in the hip joints.

Another known stretching device comprises two trough-shaped receptacles for the legs, joined together by a mechanical locking mechanism. The legs of the user are placed into the troughs and the legs are maintained in a stretched position for a period of time. Body position is limited, because the legs must fit into the troughs. Thus, hip joints are not adequately stretched.

U.S. Pat. No. 4,277,062 to Lawrence discloses an exercising device which enables a user to stretch the leg muscles while seated, with the legs straight out in front of his or her body. The straddle-stretch produced by the Lawrence device, like the above mentioned devices, does not direct stretching to the hip muscle but rather, on the inner leg and groin muscles.

U.S. Pat. No. 3,109,646 to Klein discloses a device designed to facilitate rotation of the legs in the hip joints of a user, comprising a base with a perpendicular rod projecting upward from said base, and a crosspiece parallel to said base. The user sits indian style, places the knees between the crosspiece and the base, and moves the crosspiece downward on the rod, causing the crosspiece to press the knees outward. The Klein device does not allow a user to immediately stop stretching when desired, as the crosspiece must be screwed upward on the rod in order to cease the stretch. Further, the Klein device is cumbersome and difficult to enter and exit.

My U.S. Pat. No. 4,795,150 discloses an apparatus for automated, cyclic stretching of the legs, hip and back muscles. That device enables automated, cyclic stretching of a broad range of muscles but is not particularly adapted to enable a user to focus stretching on the hip joint to increase rotation of the leg to the extent achieved by the present apparatus.

The device of the present invention enables a user to concentrate on stretching the inner leg and hip muscles for the purpose of increasing rotation of the legs in the hip joints. The speed with which muscles are stretched and the legs are rotated in the hips is controlled by the user. The device of the present invention is safe to use, because there is no possibility of a sudden jerk causing pulled muscles.

SUMMARY OF THE INVENTION

One object of the present invention is to provide a stretching apparatus for stretching the leg and hip muscles of the human body.

Another object of the invention is to provide a stretching apparatus for increasing rotation of the legs in the hip joints of the human body.

Still another object of the invention is to provide a stretching apparatus for stretching the leg and hip muscles and increasing rotation of the leg in the hip joint of the human body which enables the user to determine the speed with which the muscles are stretched and the legs are rotated.

The present invention is an improvement on the prior art devices, and comprises a novel stretching apparatus which enables precise stretching of the leg and hip muscles and rotation of the legs in the hip joints leading to increased flexibility of the hip joint.

The apparatus includes two body support platforms joined end-to-end by a hinge. One platform is connected directly to a frame. The other platform is connected through flexible straps to the frame. A user begins in a seated position and lowers his or her body to a desired level of stretch and rotation against the force of the straps. The frame forms handles which enable the user to lower the body at a controlled rate, serving to prevent injury due to sudden jerking of the muscles.

DETAILED DESCRIPTION OF THE INvENTION

Figure 1:
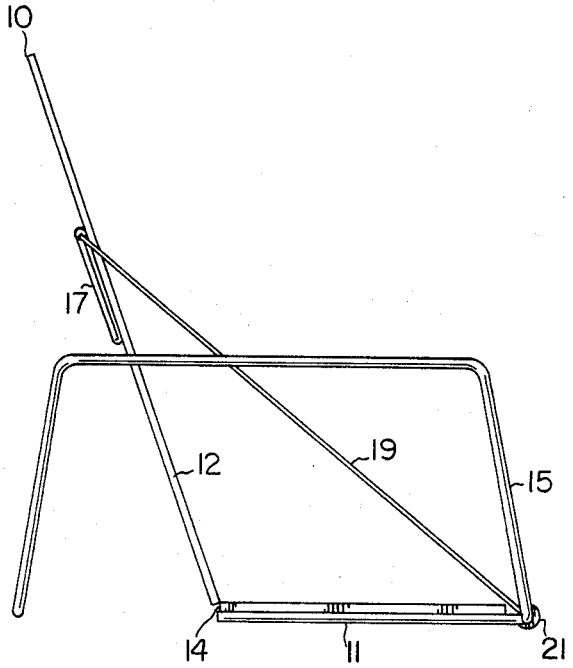
FIG. 1 is a side elevational view of an apparatus for stretching the leg and hip muscles of the human body and increasing rotation of the leg in the hip joint in accordance with the present invention, the apparatus being shown in an upright neutral position.

Generally, as shown in FIG. 1 of the drawings, the present invention relates to butterfly chair 10, comprising two body support platforms 11 and 12. In FIGS. 1–4, butterfly chair 10 is shown in an upright, neutral position. The platforms are made of plywood and are covered with vinyl and closed cell foam cushioning material. The platforms are joined end-toend by hinge 14. The hinge preferably is covered by a pad. Body support platform 11 is attached at its opposite end directly to butterfly frame 15, which is made from tubular steel. The frame may be bolted to the floor for added stability. Alternatively, frame 15 may be provided with rubber sleeve (21) on the bottom to avoid movement and scuffing the floor.

Figure 3:
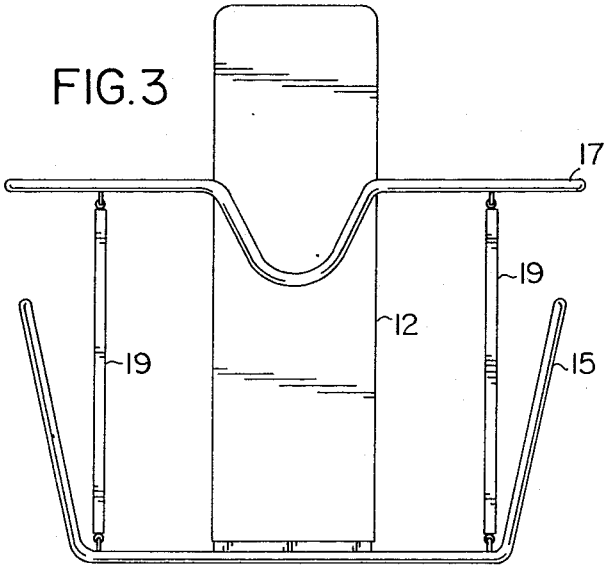
FIG. 3 is a rear elevational view of the stretching apparatus in the upright neutral position.

As seen best in FIG. 3, a V-shaped crossbar 17 is affixed by fasteners (not shown) to body support platform 12. V-shaped crossbar 17 is made from tubular steel and is covered on its ends with cushioning or gripping material. The V-shape of crossbar 17 increases the area of the crossbar 17 that is attached to platform 12, facilitating a more secure attachment.

Figure 2:
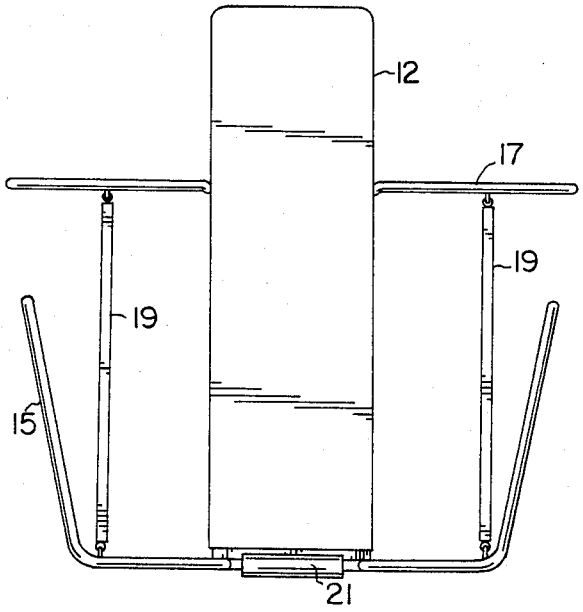
FIG. 2 is a front elevational view of the stretching apparatus in the upright neutral position.
Figure 4:
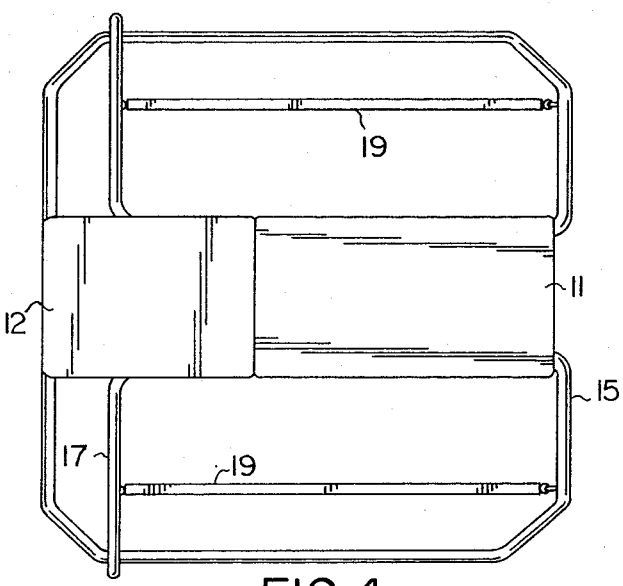
FIG. 4 is a top plan view of the stretching apparatus in the upright neutral position.
Figure 5:
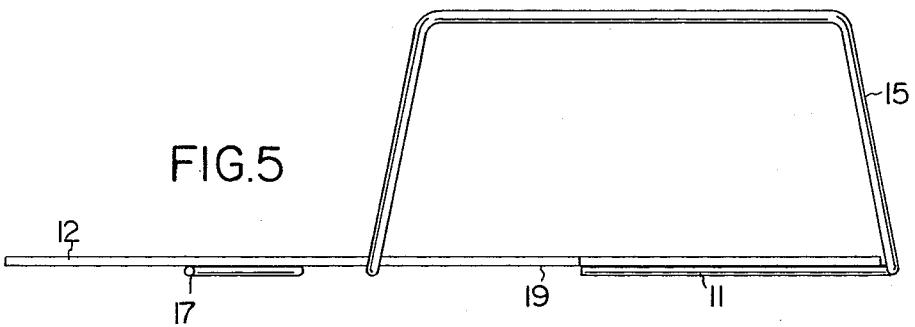
FIG. 5 is a side-elevational view of the stretching apparatus in a fully reclining position.

As seen in FIGS. 2, 3 and 4, V-shaped bar 17 is attached by flexible straps 19 to butterfly frame 15. Straps 19 are attached at their respective ends to V-shaped bar 17 and butterfly frame 15 with S-hooks. Straps 19 may be a single piece of rubber or a two-piece composite of nylon or cotton and leather, with only the rubber piece being stretchable. If desired, a pad or sleeve can be used to cover straps for added comfort. As seen in FIG. 5, when body support platform 12 is in a fully reclined position, straps 19 are fully stretched to become taut.

In the use of the butterfly chair apparatus 10, the apparatus initially is in an upright position, as shown in FIG. 1. A user sits on body support platform 11 and rests his or her back against body support platform 12. The user can select one of two positions for his or her legs while using the apparatus. In the first position, the user presses the soles of the feet together and pulls the heels in toward the body as closely as possible, which causes the knees to point straight out to the sides. This corresponds to the first position in ballet. The second position is a slight modification of the first. In the second position, the feet are apart so that the foreleg and thigh form a 90 degree angle. This corresponds to the second position in ballet.

In either the first or second position, the seated user places straps 19 over the legs so that a portion of the straps are resting on the inside of the knees. The user then grasps butterfly frame 15 and allows his or her upper body weight to push body support platform 12 into a reclining position against the force of straps 19.

As body support platform 12 is pushed backward into a reclining position, straps 19 become taut and gently force the legs of the user to rotate in the hip joints. In that position, the user resembles a butterfly.

The user controls the speed with which body support platform 12 moves backward by partially supporting his or her weight by holding on to butterfly frame 15. Holding onto the frame 15 also assists entering and leaving the apparatus. The user can choose to stop body support platform 12 before it reaches a full reclining position by simply supporting his or her full body weight by grasping onto butterfly frame 15. This enables individuals who are not very flexible to work slowly and gradually to stretch the muscles and rotate the joints. Each user can utilize the device to the extent most comfortable. Progress can be achieved by gradually lowering body platform 12 to greater extent each time the apparatus is used.

Once body support platform 12 is fully reclined, the user can remain still and enable the joints to remain in a rotated position, or the user can use the arms to gently pull himself or herself back into the starting position.

The apparatus of the invention has been found particularly useful in stretching the inside thigh and groin muscles and the hip joints and in increasing flexibility and leg rotation in the hip joint. Other uses of the apparatus will be apparent to those skilled in the art.

The invention has been described in connection with the preferred embodiment. It should be appreciated that various modifications could be made to the apparatus and its method of operation without departing from the spirit and scope of the invention.

I claim:

1. A muscle and joint stretching apparatus for stretching human leg and hip muscles and increasing rotation of the leg in the hip joint of a user when in a reclining position, said apparatus comprising:

(a) two body support platforms connected end-to-end at an angle .arranged such that a user may sit upright on a first support body platform and rest the back of the body on a second platform or lie on the top sides of both platforms;

(b) a frame connected to one end of the first body support platform;

(c) a crossbar connected to the second body support platform; and (d) a pair flexible straps, each strap connected to said crossbar at one end and said frame at the other end, whereby upon expansion of the angle between the body support platforms by the reclining of the user against the force of the flexible strap, the user's leg muscles and hip joint are stretched, and the user's leg is rotated outwardly in the hip joint.

2. Apparatus according to claim 1, further comprising means on said frame for preventing the apparatus from sliding during use.

3. Apparatus according to claim 1, wherein said crossbar is V-shaped at a location behind said second body support platform.

4. A method of stretching leg and hip muscles and increasing rotation of the leg in the hip joint of the human user, comprising:

(a) arranging two body support platforms connected end-to-end at an angle such that a user lies or sits on both platforms;

(b) arranging two flexible straps over the knees of a human user such that when the angle between said body support platforms increases, the straps become taut around the knees; and (c) causing the angle between the platforms to increase, thereby forcing the straps to cause the knees to point outward, the muscles to become stretched and the legs to rotate in the hip joints.

* * * * *